US005657897A

United States Patent [19]

Schwartzburg

[11] Patent Number: 5,657,897

[45] Date of Patent: Aug. 19, 1997

[54] BEVERAGE CONTAINER CONSTRUCTED TO ACCOMMODATE CUP HOLDERS OF DIFFERENT SIZES

[75] Inventor: James H. Schwartzburg, Lawrence, Kans.

[73] Assignee: PackerWare Corporation, Lawrence, Kans.

[21] Appl. No.: 554,668

[22] Filed: Nov. 8, 1995

[51] Int. Cl.[6] ..... B65D 25/00

[52] U.S. Cl. ..... 220/669; 220/675; 229/400

[58] Field of Search ..... 220/669, 671, 220/675; 229/403, 400

[56] References Cited

U.S. PATENT DOCUMENTS

| | | | |
|---|---|---|---|
| D. 47,527 | 6/1915 | Sanford . | |
| D. 81,984 | 9/1930 | Kirkpatrick . | |
| D. 198,139 | 5/1964 | Edwards . | |
| D. 204,783 | 5/1966 | Johnson . | |
| D. 362,368 | 9/1995 | Willbrandt . | |
| 604,514 | 5/1898 | Belden . | |
| 2,963,256 | 12/1960 | Borah . | |
| 3,045,887 | 7/1962 | Caine | 220/675 X |
| 3,079,027 | 2/1963 | Edwards . | |
| 3,194,468 | 7/1965 | Baron | 220/675 X |
| 3,484,018 | 12/1969 | Davis . | |
| 3,934,725 | 1/1976 | Edwards . | |
| 4,061,782 | 12/1977 | Baxter . | |
| 4,231,476 | 11/1980 | Compton et al. . | |
| 4,832,202 | 5/1989 | Newman et al. . | |
| 5,176,284 | 1/1993 | Sorensen | 220/671 X |
| 5,415,339 | 5/1995 | Howard | 220/671 X |
| 5,427,269 | 6/1995 | Willbrandt . | |

*Primary Examiner*—Steven M. Pollard

*Attorney, Agent, or Firm*—Kokjer, Kircher, Bowman & Johnson

[57] ABSTRACT

A beverage container for accommodating drink cup holders which vary in size. The container has a large diameter upper portion which presents a large capacity and a small diameter lower portion connected with the upper portion by a shoulder. The lower portion fits in a cup holder and has projecting fins which are triangular. The fins extend along the lower cup portion on one side, along the shoulder on another side and may contact the wall of the drink holder on the third side. The fins are flexible and are offset from a radial orientation so that they can contact the drink holder wall with sufficient force to hold the cup in a stable position.

14 Claims, 2 Drawing Sheets

BEVERAGE CONTAINER CONSTRUCTED TO ACCOMMODATE CUP HOLDERS OF DIFFERENT SIZES

FIELD OF THE INVENTION

This invention relates in general to beverage containers and deals more particularly with a beverage container having a special construction providing a large volume and yet permitting the container to fit in drink holders of different sizes.

BACKGROUND OF THE INVENTION

In recent years, it has been common practice for automobiles and other vehicles to be provided with built-in drink holders which are typically of a size to receive a conventional 12 ounce aluminum can. Although this type of drink holder is satisfactory to accommodate beverage cans in a stable manner, many other beverage containers are too large to fit in the drink holder. For example, it is common for fast service food outlets to sell drinks in sizes of 20 ounces and more. The bases of the cups that are used to serve these large drinks are too large to fit in the drink holder, and the large drink sizes are becoming more and more prevalent to compound this problem.

It is not practical to simply increase the container height to provide a container that is small enough in diameter to fit in the drink holder at its lower end and yet present the desired large capacity. The reason is that the height of the cup is limited to that which can fit beneath the drink dispenser. There are other practical considerations that limit the size and configuration of the beverage container.

There have been cups that have a relatively small diameter bottom end portion to fit into the drink holder and a larger diameter upper portion to provide the necessary volume without undue height. An example of this type of cup is disclosed in U.S. Pat. No. 5,427,269 to Willbrandt. One problem with this construction is that the vehicle drink holders that are currently in use are not standard in diameter. Consequently, the relatively small lower end portion of the cup may fit well in some holders and yet fit so loosely in others that the cup is unstable and subject to overturning or spilling of its contents.

SUMMARY OF THE INVENTION

The present invention has, as its principal goal, the provision of a beverage cup which presents a larger volume and yet fits well in cup holders that vary considerably in diameter. In accordance with the invention, a beverage cup has a relatively small diameter lower end portion which is small enough to fit within even relatively small drink holders such as those sized to closely receive conventional 12 ounce aluminum cans. A large diameter upper portion of the cup provides the desired large capacity and is connected by a shoulder with the lower portion of the cup.

It is a particular feature of the invention that the lower portion of the cup body has a plurality of outwardly projecting fins. The fins act against the wall of the drink holder in cases where the drink holder cavity is larger in diameter than the lower portion of the cup. The fins are flexible so that they exert enough force on the cavity wall to assure that the cup is maintained in a stable position in the drink holder. Due to the presence of the flexible fins, the cup is able to fit in a stable manner in cup holders which vary in diameter between that of the lower portion of the cup and that of the lower end of the upper portion of the cup. A single cup thus accommodates a wide variation in the size of the holder to make it compatible with the wide variety of drink holder sizes that are prevalent.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
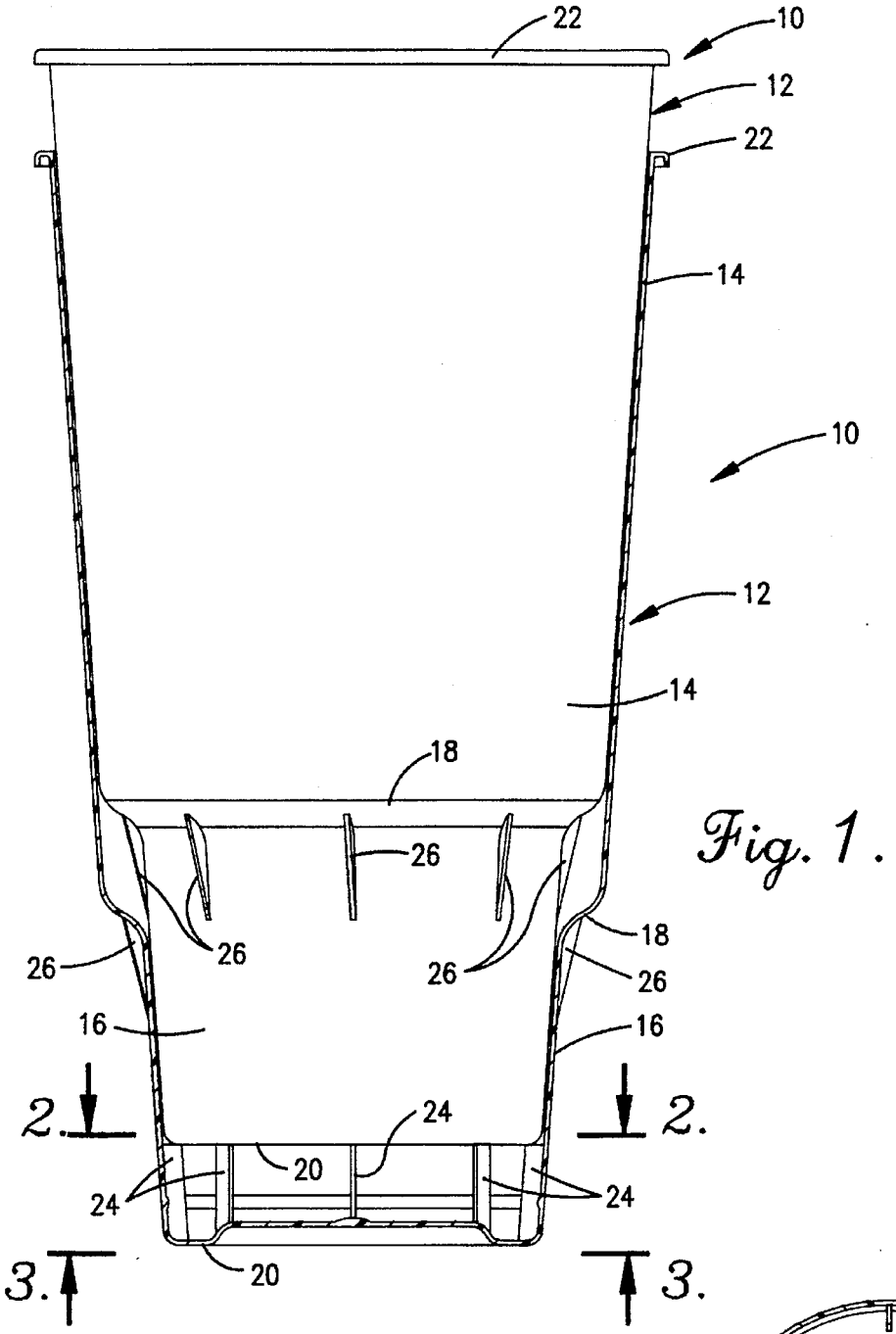
FIG. 1 is a side elevational view illustrating a pair of beverage cups constructed in accordance with the present invention nested one within the other, with the outer cup in the nested arrangement shown in section.
Figure 2:
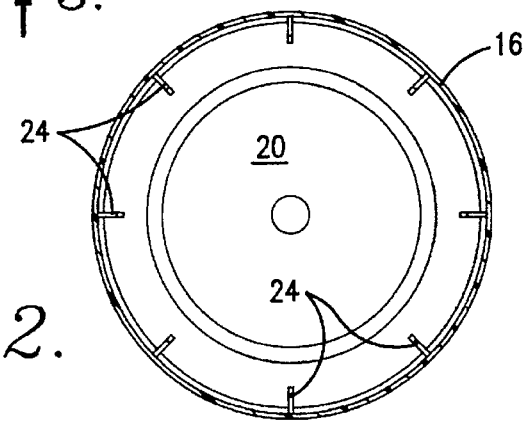
FIG. 2 is a sectional view taken generally along line 2—2 of FIG. 1 in the direction of the arrows.

Referring now to the drawings in more detail, numeral 10 generally designates a beverage cup constructed in accordance with the present invention. The cup 10 may be constructed of injection molded plastic and may be of the type commonly used in fast service food outlets and otherwise to serve beverages such as soft drinks. FIG. 1 shows a pair of the cups 10 stacked in a nesting relationship one within the other.

The cup 10 is formed as an integral cup body 12 having an upper body portion 14 and a lower body portion 16 connected with one another by a shoulder 18. Both the upper body portion 14 and lower body portion 16 are generally cylindrical, although they both flare slightly from bottom to top. The upper body portion 14 is considerably larger in diameter than the lower body portion 16 and is taller than the lower body portion. The reason the lower body portion 16 has a relatively small diameter is to enable it to fit within a drink holder such as the type commonly found in automobiles and other vehicles. The upper portion 14 has a relatively large diameter in order to provide the cup body 12 with a larger volume to accommodate the desired amount of the beverage which it holds.

A bottom 20 is formed at the bottom end of the of the lower portion 16 and closes the bottom end portion of the cup body. The top end of the upper body portion 14 is open and presents an outwardly turned rim 22. The shoulder 18 connects the top end of the lower body portion 16 with the bottom end of the upper body portion 14 and extends between the two in a direction to angle upwardly from the lower body portion 16 to the upper body portion 14. A plurality of short stacking ribs 24 are provided internally of the lower body portion 16. The ribs 24 are adjacent to the bottom 20 of the cup and are spaced apart around the circumference of the lower body portion 16 such that the bottom end of another cup 10 can rest on their upper edges when two of the cups are arranged in a nesting relationship such as that shown in FIG. 1.

The lower body portion 16 is provided with a plurality of outwardly projecting fins 26. The fins 26 are preferably spaced equidistantly around the circumference of the lower body portion 16 and may be present in any suitable number such as the eight fins depicted in FIG. 3. The fins 26 are adjacent to the shoulder 18. Each fin 26 is generally triangular and has one side extending along the wall of the lower body portion 16 and another side extending along the shoulder 18. The third side of each of the triangular ribs 26 is a free edge.

Figure 3:
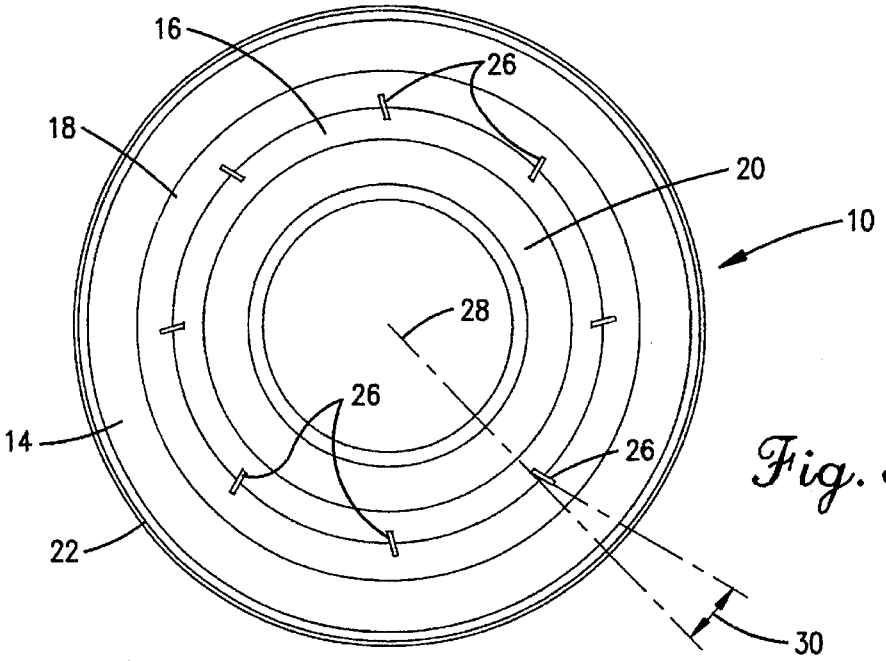
FIG. 3 is a sectional view taken generally along line 3—3 of FIG. 1 in the direction of the arrows.

As best shown in FIG. 3, each of the ribs 26 occupies a plane that is offset from a radial orientation relative to the lower body portion 16. Preferably, the angle 30 between the plane of each fin 26 and a radial line 28 is in the range of approximately 5°–25°. In a preferred embodiment of the invention, the angle 30 is approximately 15°.

The cup 10 may be provided with a removable lid (not shown), and it may have a conventional construction.

In use, the cup 10 is filled with beverages such as soft drinks and the like. The construction of the cup 10 makes it particularly well suited for use with drink holders of the type commonly found in automobiles and other vehicles.

Figure 4:
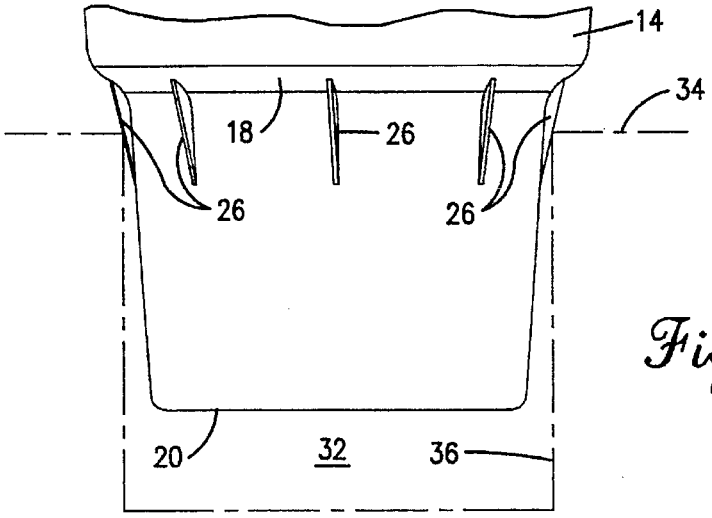
FIG. 4 is a fragmentary elevational view of the lower end of the cup of FIG. 1 and showing the cup fitted into a relatively small drink holder.

FIG. 4 depicts the cup 10 in place in a relatively small drink holder which takes the form of a cylindrical cavity 32. The cavity 32 extends downwardly into a horizontal surface 34 and is bounded by a cylindrical wall 36. The circumference of the cavity 32 is slightly larger than that of the lower cup portion 16 so that the lower cup portion 16 can fit into the cavity. As shown in FIG. 4, the free edges of the fins 26 contact the cavity wall 36 at its upper edge portion. Because the fins 26 are flexible and because they are offset from a radial orientation relative to the lower cup portion 16, the fins 26 flex against the cavity wall 36 and thereby provide sufficient force to hold the cup 10 in place in the cup holding cavity 32 in a stable position.

When the cup is full of liquid, it is top heavy and thus tends to be unstable. The weight of the liquid causes the cup to assume a snug position in the drink holder with the fins 26 exerting enough force on the cavity wall to hold the cup in a stable position.

Figure 5:
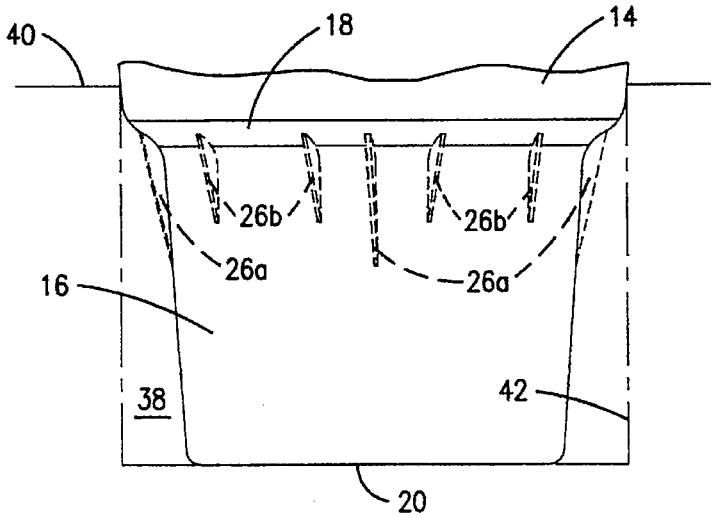
FIG. 5 is a fragmentary elevational view similar to FIG. 5, but showing the cup fitting in a larger drink holder and showing an alternative arrangement of the fins in broken lines.

Referring now to FIG. 5, another drink holder presents a cylindrical cavity 38 which is approximately the same diameter as the bottom end of the upper body portion 14 of the cup. The cavity 38 extends downwardly into a horizontal surface 40 and is bounded by a cylindrical wall 42. Because of the relatively large size of the cavity 38, the entirety of the lower body portion 16 can fit within it, and the bottom 20 may rest on the bottom of the cavity. The bottom end of the upper body portion 14 may contact the wall 42 at its upper edge portion. This also provides the cup 10 with a stable position within the drink holder.

It is evident that by reason of its construction and particularly the provision of the fins 26, the cup 10 can be easily accommodated in a drink holder having a cavity with a diameter as small as that of the lower body portion 16 at a location adjacent to the bottom edges of the fins 26. The cup can be accommodated in drink holders with cavities as large as that depicted in FIG. 5. With drink holding cavities between these extremes, the free edges of the ribs 26 engage the cavity walls at various locations from top to bottom along the free edges of the fins. The flexibility of the fins allows them to engage the cavity wall with sufficient force to maintain the cup in a stable position. At the same time, the fins allow the cup to accommodate cup holding cavities which vary considerably in diameter. The offset of the fins from a radial orientation enhances their ability to flex as intended when they are engaged against the cavity walls and prevents the fins from being damaged by buckling or otherwise when they are inserted into and removed from the drink holder.

The arrangement of the fins around the circumference of the lower portion of the cup can vary. For example, FIG. 5 depicts one possible arrangement in which the fins are arranged in groups of three, with the center fin **26*a* in each group of fins being longer than the other two fins 26*b*** in the group. Other fin arrangements, shapes and orientations may also be used without detracting significantly from the ability of the fins to perform their intended function. The cup can also be used with drink holders which present only a circular edge around the cup instead of a wall surface.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described the invention, what is claimed is:

1. A beverage container for use with generally cylindrical container holding cavities which extend into vehicle surfaces, said container comprising:

a container body having generally cylindrical upper and lower body portions, said upper body portion having a diameter greater than the diameter of said lower body portion;

a shoulder on said container body connecting said upper and lower body portions; and a plurality of flexible fins on said lower body portion projecting outwardly therefrom, said fins acting to contact a surface extending around a cavity into which the container body lower body portion is inserted and said fins flexing to accommodate insertion of the container into cavities of different diameters, and wherein each fin occupies a plane offset from a radial orientation relative to the lower body portion of the container.

2. The container of claim 1, wherein each fin occupies a plane offset by between about 5° and about 25° from a radial orientation relative to the lower body portion of the container.

3. The container of claim 1, wherein each fin occupies a plane offset by about 15° from a radial orientation relative to the lower body portion of the container.

4. The container of claim 1, wherein said fins are adjacent to said shoulder.

5. The container of claim 4, wherein each fin has a generally triangular shape with a first side extending along said lower body portion, a second side extending along said shoulder, and a third side for contact with the cavity surface.

6. A beverage container for use with a generally cylindrical container holding cavity which is bounded by a surface, said container comprising:

a container body having generally cylindrical upper and lower body portions each presenting a top end and a bottom end, said bottom end of the lower body portion being closed and said top end of the upper body portion being open;

a shoulder connecting said top end of the lower body portion with said bottom end of the upper body portion; and a plurality of flexible fins projecting outwardly from said lower body portion of the container at a location adjacent the top end thereof, said fins flexing against said surface of a cavity into which said lower body portion is inserted to stabilize the container body and wherein each fin occupies a plane offset from a radial orientation relative to the lower body portion of the container.

7. The container of claim 6, wherein each fin occupies a plane offset by between about 5° and about 25° from a radial orientation relative to the lower body portion of the container.

8. The container of claim 6, wherein each fin occupies a plane offset by about 15° from a radial orientation relative to the lower body portion of the container.

9. The container of claim 6, wherein each fin has a generally triangular shape with a first side extending along said lower body portion, a second side extending along said shoulder, and a third side for contact with the cavity surface.

10. A beverage container for use with a generally cylindrical container holding cavity which is bounded by a surface, said container comprising:

a container body having generally cylindrical upper and lower body portions, said upper body portion having a larger diameter than said lower body portion;

a shoulder on said container body extending between and connecting said upper and lower body portions; and a plurality of flexible fins projecting outwardly from said lower body portion, each fin occupying a plane which is offset from a radial orientation relative to said lower body portion, said fins being flexible to flex against said surface of a cavity into which said lower body portion is inserted to stabilize the container body in the cavity, and wherein each fin occupies a plane offset by between about 5° and about 25° from a radial orientation relative to the lower body portion of the container.

11. The container of claim 10, wherein each fin occupies a plane offset by about 15° from a radial orientation relative to the lower body portion of the container.

12. The container of claim 10, wherein said fins are adjacent to said shoulder.

13. The container of claim 12, wherein each fin has a generally triangular shape with a first side extending along said lower body portion, a second side extending along said shoulder, and a third side for contact with the cavity surface.

14. The container of claim 10, wherein each fin has a generally triangular shape with a first side extending along said lower body portion, a second side extending along said shoulder, and a third side for contact with the cavity surface.

* * * * *